US005423163A

United States Patent [19]

Wendt

[11] Patent Number: 5,423,163

[45] Date of Patent: Jun. 13, 1995

[54] FREE STANDING PALLET WRAPPING APPARATUS

[75] Inventor: Terry A. Wendt, Rogersville, Mo.

[73] Assignee: Iron Eagle, Inc., Rogersville, Mo.

[21] Appl. No.: 110,812

[22] Filed: Aug. 23, 1993

[51] Int. Cl.[6] ..... B65B 53/00; B65B 13/04

[52] U.S. Cl. ..... 53/556; 53/588

[58] Field of Search ..... 53/210, 556, 588

[56] References Cited

U.S. PATENT DOCUMENTS 4,271,657 6/1981 Lancaster, III et al. .
4,616,474 10/1986 Morley et al. .
4,829,743 5/1989 Kapke .
4,934,123 6/1990 Salzsauler .
4,993,209 2/1991 Haloila .
5,040,359 8/1991 Thimon .
5,107,657 4/1992 Diehl et al. .
5,155,970 10/1992 Moore .

*Primary Examiner*—Linda B. Johnson
*Attorney, Agent, or Firm*—Silverman, Cass & Singer, Ltd.

[57] ABSTRACT

A mobile apparatus detachably connected to a source of pressurized fluid for wrapping palletized load with a film and which includes a rotating arm rotatably mounted to a movable support frame, a carriage rail attached to the rotating arm, a film carriage in slidable engagement with the carriage rail for dispensing the film to the load, a pneumatic carriage lift cylinder for selectively actuating the movement of the film carriage along the carriage rail, a pneumatic drive assembly for selectively actuating rotational movement of the rotating arm, and a control panel attached to the frame and detachably connected to the pressurized fluid source for selectively controlling the carriage lift cylinder and the drive assembly.

14 Claims, 3 Drawing Sheets

FIG. 2
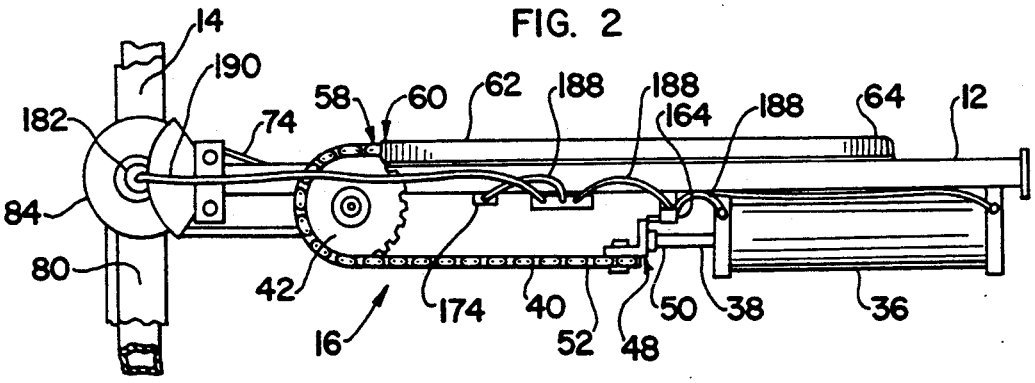
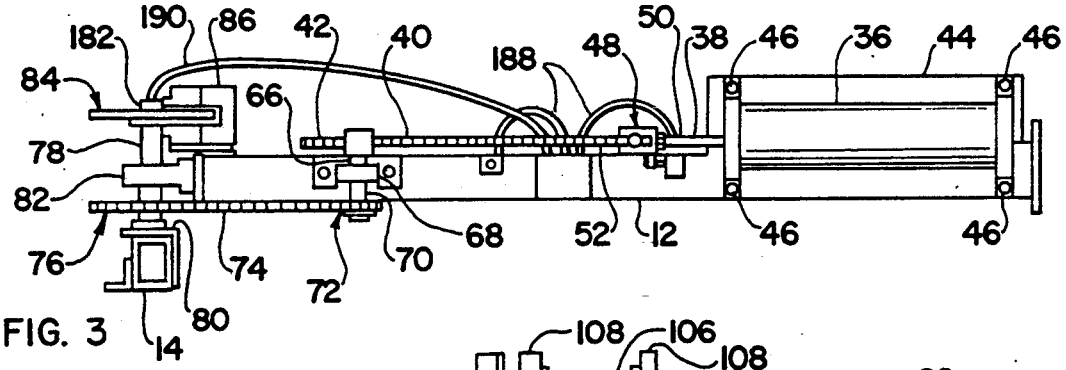
FIG. 3
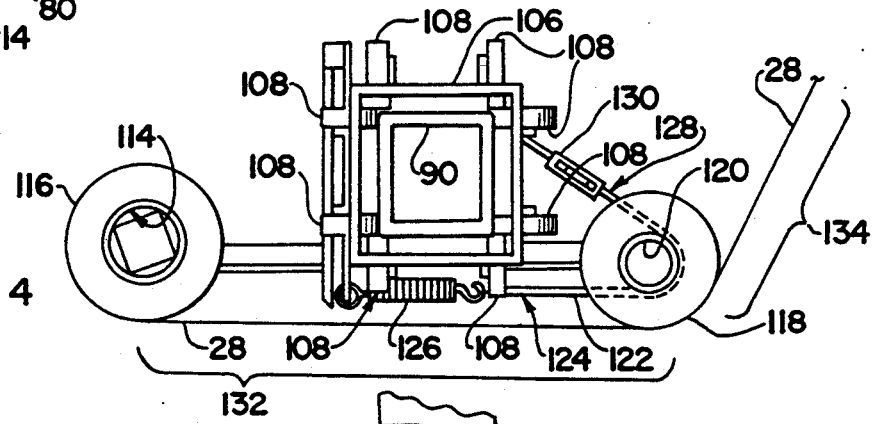
FIG. 4
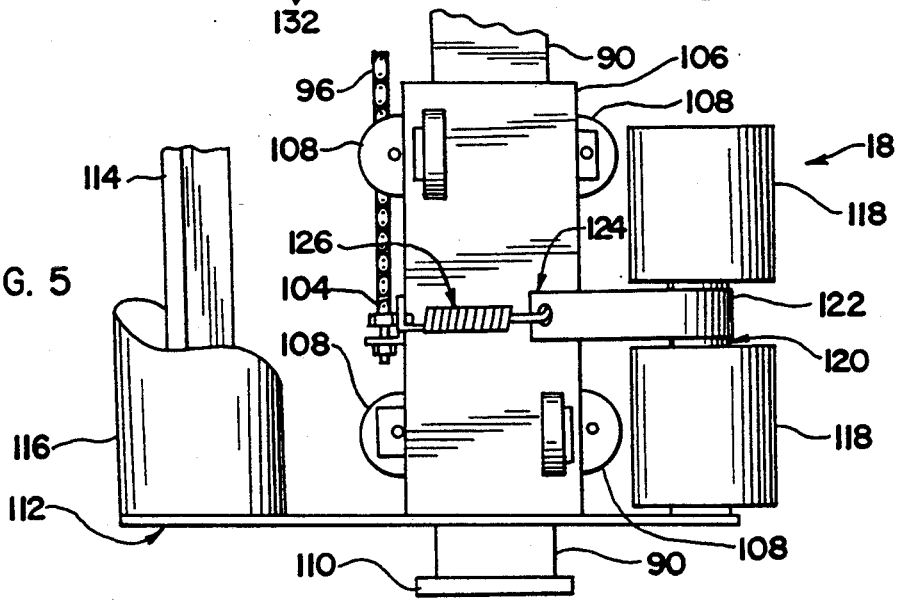
FIG. 5

FREE STANDING PALLET WRAPPING APPARATUS1.

FIELD OF THE INVENTION

This invention relates generally to apparatus for wrapping loads on a pallet with a film, and more particularly, to a mobile, free standing wrapping apparatus for wrapping loaded pallets or skids wherein the apparatus includes a controlled rotatable arm and slidable film dispenser actuated by pneumatic cylinders.

2. DESCRIPTION OF THE RELATED ART

Wrapping devices are commonly used to wrap loaded pallets with multiple layers of a film prior to shipping. These wrapping devices generally accomplish wrapping either by orbiting a roll of film about the load, or by using a stationary roll of film and rotating the load itself. In those devices which orbit the roll of film about a stationary load, an arm typically is attached to a frame at a pivot point and the roll of film is attached to the arm. The film is dispensed to the load as the arm rotates.

The film used to wrap a load may have a width approximate the height of the load, so that wrapping only requires rotation of the film dispenser about the load. To vary the wrap pattern, the film width may be substantially less than the load height and the film dispenser may be reciprocated vertically during rotation to create a spiral wrap pattern. Film has also been bunched and dispensed as a rope.

The support frame used to support the different wrapping devices of the prior art typically is mounted on the floor, a wall or other similar fixed structure. As a result, an operator must transport the load to the wrapping device, position the load for wrapping, and thereafter must remove the load. Methods of moving the load may include forklifts and conveyors. Disadvantages include the multiple handling of the loads, the additional complexity of the devices, and the lack of mobility.

To increase mobility, a wrapping device may be mounted to a vehicle or mounted on a gantry. An example of one such device is illustrated in U.S. Pat. No. 4,905,448, which discloses floor, wall, truck and gantry mounted film wrapping machines which may dispense full or spiral wraps of film. This patent further discloses the use of electric motors to provide rotation to a rotary arm and vertical movement imposed on a film dispenser. While the patent discloses that the motor driving the rotary arm may be hydraulically driven, it only discloses an electrically driven motor for movement of the film dispenser. The device does not disclose either a fully pneumatic or hydraulically powered wrapping device or a wrapping device that has severed its dependency upon electrical connections and power sources.

It therefore would be desirable to provide a completely pneumatic wrapping device which actuates rotation of the rotary arm and movement of the film dispenser through the use of pressurized reciprocating cylinders. It is also desirable to provide a safe wrapping device where moving parts may be controlled manually for starting and stopping the apparatus. It is further desirable to provide an economic wrapping device which does not require connection to an electrical power source and the resulting consumption of electricity. Mobility of the apparatus embodying the invention also is desirable.

SUMMARY OF THE INVENTION

The invention provides an apparatus detachably connected to a source of pressurized fluid for film wrapping of a load on a pallet. The apparatus includes a rotating arm rotatably mounted to a mobile support frame. A vertical carriage rail is attached to the end of the rotating arm, and a film carriage is slidably engaged with the carriage rail. The film carriage may slide vertically in opposite directions while dispensing the film to the load as the rotating arm rotates. To vary a pattern of wrap applied to the load, a pneumatic carriage lift cylinder controls the movement of the film carriage along the carriage rail. A pneumatic drive assembly provides selective control of the wrapping operation by providing rotational movement of the rotating arm. A control panel which is detachably connected to the pressure source provides for the selective control of the carriage lift cylinder and the drive assembly.

BRIEF DESCRIPTION OF THE DRAWINGS

FIG. 2 is a fragmentary top elevational view of a drive assembly for rotation of a rotating arm.

FIG. 3 is a side elevational view of the drive assembly of FIG. 2.

FIG. 4 is a top elevational view of a film dispensing apparatus.

FIG. 5 is a fragmentary side elevational view of the film dispensing apparatus of FIG. 4.

DESCRIPTION OF THE PREFERRED EMBODIMENTS

Figure 1:
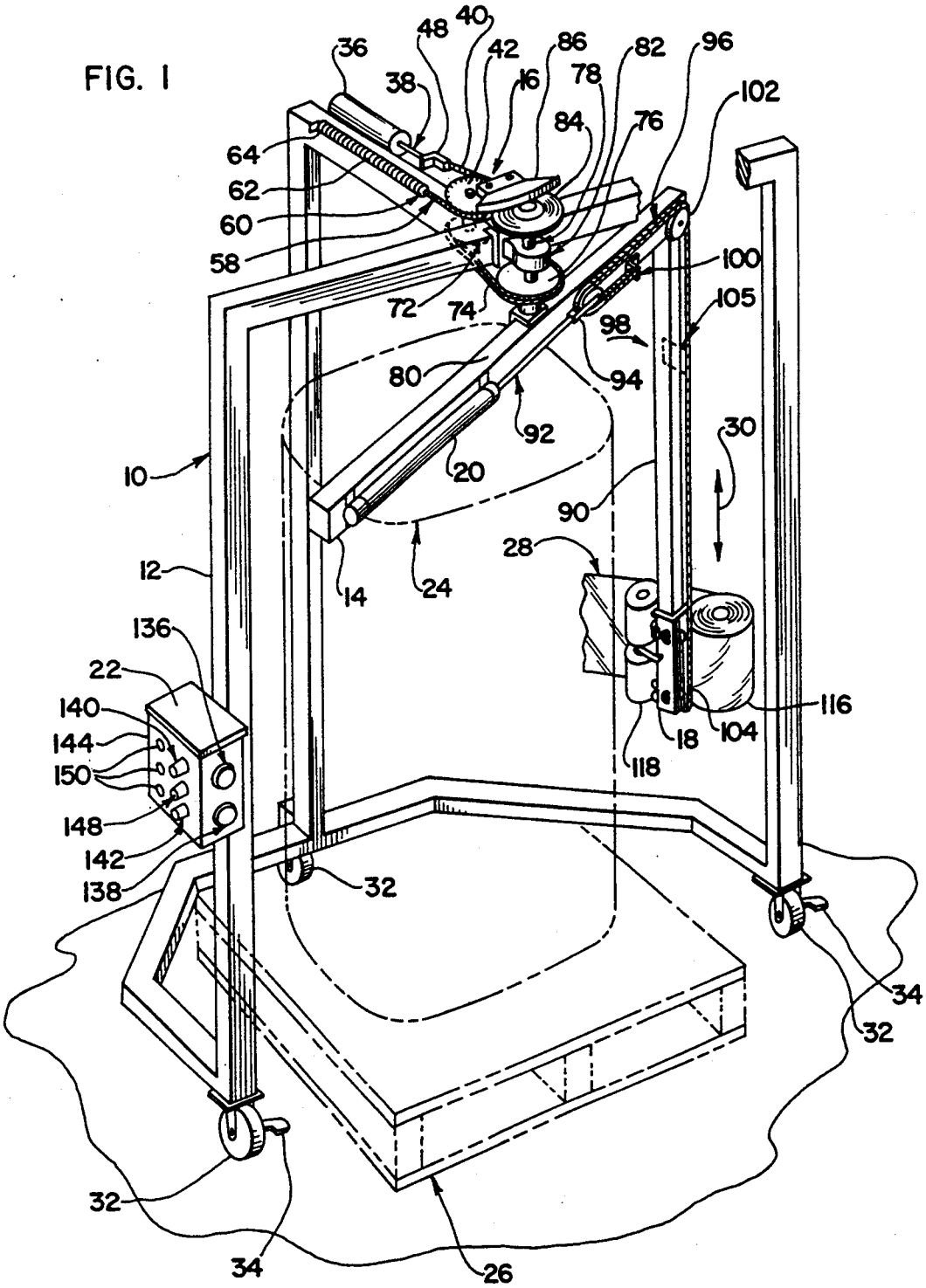
FIG. 1 is a perspective view of the pallet wrapping apparatus embodying the invention, with cover removed.

Referring to FIG. 1, the pallet wrapping apparatus is designated generally by the reference numeral 10 and is illustrated with all covers for the moving parts removed. The apparatus 10 includes a support frame 12, a rotating arm 14, a drive assembly 16, a film carriage 18, a carriage lift cylinder 20 and a control panel 22.

Briefly, in operation, the pallet wrapping apparatus is used to wrap a load 24 on a pallet 26, both shown in phantom outline in FIG. 1. The drive assembly 16 actuates the rotating arm 14 to rotate about the load 24. As the rotating arm 14 rotates, a film 28 is dispensed about the load 24 from the film carriage 18. To vary the application of the film 28 to the load 24, the film carriage 18 may move vertically in the direction of arrows 30. Vertical movement is actuated by the carriage lift cylinder 20. An operator controls both the drive assembly 16 and the carriage lift cylinder 20 by a control panel 22 connected to a conventional source of pressurized fluid (not shown), preferably air.

The frame 12 preferably is constructed of square metal stock, although any other suitable material or shape may be used. To provide mobility to the pallet wrapping device 10, conventional casters 32 may be selectively mounted to the lower ends of frame 12. The mounted casters 32 enable ready movement of the apparatus wrapping device 10 from one pallet location to another, thereby decreasing unnecessary handling and transport of loaded pallets. The casters 32 preferably have a locking capability, such as a brake 34, to prevent movement of the apparatus 10 during the wrapping operation.

Attached to the frame 12 is the drive assembly 16. Briefly, the drive assembly 16 includes a drive cylinder 36 having a reciprocating cylinder shaft 38. Generally, the cylinder shaft 38 engages a sprocket chain 40 which in turn engages a reciprocating sprocket 42. Referring to FIG. 3, the drive cylinder 36 is a reciprocating pneumatic cylinder attached to a plate 44 on the frame 12 by bolts 46.

Referring to FIG. 2, the cylinder shaft 38 is driven by a piston (not shown) within the drive cylinder 36. A shaft end 50 of the cylinder shaft 38 is directly attached to a first end 52 of the sprocket chain 40 by lobe 48. A screw or other such fastener may be used to join the first end 52 to the lobe 48. To maintain a constant linear pulling force on the sprocket chain 40, the second end 58 of the sprocket chain 40 is joined by a bolt or other similar fastener to a free end 60 of a spring 62, with the opposite end 64 of spring 62 being fixedly attached to the frame 12.

To keep the cylinder shaft 38 at full extension when the spring 62 is fully contracted, the spring 62 should be short enough so as to pull the sprocket chain 40 about the reciprocating sprocket 42, which induces a linear pulling force on the lobe 48 of the cylinder shaft 38. When the cylinder shaft 38 retracts during operation, the spring 62 stretches to permit movement of the sprocket chain 40. As the cylinder shaft 38 cycles between extension and retraction, the reciprocating sprocket 42 rotates back and forth.

In an alternative arrangement of the lobe 48 and sprocket chain 40, the lobe 48 has a post member (not shown). To provide increased torque to the reciprocating sprocket 42, the first end 52 of the sprocket chain 40 is mounted to an L-shaped bracket (not shown) welded or bolted to the frame 12. The sprocket chain 40 is threaded about the post member (not shown) of the lobe 48. The post member 52 preferably is a sprocket which engages the sprocket chain 40, however it may be a pin or other similar structure so long as the sprocket chain 40 freely slides through the lobe 48. This alternative arrangement provides additional torque if needed.

Referring to FIG. 3, the reciprocating sprocket 42 drives a reciprocating shaft 66. To transform the linear movement of the reciprocating sprocket 42 and reciprocating shaft 66 into rotary motion, the reciprocating shaft 66 is operatively engaged with a roller bearing clutch 68. An inside race (not shown) of the roller bearing clutch 68 rotates free in relation to an outside race (not shown) when rotated in one direction and locks the outside race (not shown) when rotated in the opposite direction.

The roller bearing clutch 68 also is operatively engaged with a rotational shaft 70 and the action of the inside and outside races creates pulsating rotation of the rotational shaft 70. This type of bearing arrangement is well known to those skilled in the art as a pitman-type connection. To vertically support the rotational shaft 70, the clutch bearing (not shown) of the roller bearing clutch 68 is attached to the rotational shaft 70.

The rotational shaft 70 is attached to a drive sprocket 72 shown in phantom outline in FIG. 1. The drive sprocket 72 engages an endless drive chain 74 which in turn drives a driven sprocket 76. The driven sprocket 76 engages a drive shaft 78 which is mounted to the top surface 80 of the rotating arm 14.

To support the weight of the rotating arm 14, the drive shaft 78 extends through and operatively engages a bearing 82, as illustrated in FIG. 3. Preferably this bearing 82 would be a tapered-roller bearing which is well known in the art. A number of other bearing types, however, might suffice so long as they support the weight of the arm 14 while allowing rotation.

To stop selectively or restrict the rotary motion of the rotating arm 14, the drive shaft 78 is attached to a disk 84 of a brake assembly 86. The brake assembly 86 is of the disk brake type known in the art. The operator may actuate the brake assembly 86 through the control panel 22, as will be discussed in more detail hereinafter.

Referring to FIG. 1, the rotating arm 14 includes a vertical carriage rail 90. The film carriage 18 travels vertically along this carriage rail 90. To move the film carriage 18, a carriage lift cylinder 20 is bolted to the rotating arm 14. The carriage lift cylinder 20 preferably is a pneumatic reciprocating cylinder of the same type as the drive cylinder 36. The lift cylinder 20 includes a cylinder shaft 92 having a lobe 94. The lobe 94 has a post member (not shown) preferably a sprocket. A piston (not shown) in the lift cylinder 20 drives the cylinder shaft 92.

To transfer the linear reciprocating motion of the cylinder shaft 92 to the film carriage 18, a lift chain 96 has a fixed end 98 attached to an L-shaped bracket 100 welded or bolted to the rotating arm 14. The lift chain 96 loops through the lobe 94 and engages around a freely rotating sprocket 102 mounted to the end of the carriage rail 90. The lift chain 96 is extended for attachment of its free end 104 to the film carriage 18. The lift chain 96 may be so attached by means of bolts or other suitable fasteners.

To adjust the upward limit of travel of the film carriage 18 so that it matches the height of a particular load 24, a stop limit bracket 105 may be attached to the carriage rail 90. Preferably, the stop limit bracket 105 is made of metal plating which is temporarily mounted to the carriage rail 90 by bolts. Other fastening methods may be used so long as they can withstand the upward force of the moving film carriage 18 until such time as the operator disengages the carriage lift cylinder 20. It is possible to install a limit switch which would automatically disengage the lift cylinder 20.

FIG. 5 illustrates a side view of the film carriage 18 and a portion of the carriage rail 90. The film carriage 18 includes a body 106 preferably constructed of metal plating or square stock. To guide the film carriage 18 as it travels linearly along the carriage rail 90, a number of carriage wheels 108 are mounted on the body 106 in contact with the carriage rail 90. A stop plate 110 preferably welded or bolted to the end of the carriage rail 90 limits the downward travel of the film carriage 18.

The body 106 of the film carriage 18 also includes a platform 112 with a film supply mandrel 114 mounted to the platform 112. A film roll 116 is installed on the film supply mandrel 114 so that it is free to rotate. The film roll 116 is a roll of plastic wrapping material of suitable strength and elasticity. Also mounted to the platform 112 is a film tension roll 118 which also rotates.

A center portion of the film tension roll 118 is cut away which exposes a center shaft 120. To retard the rotation of the film tension roll 118, a film tension band 122 is wrapped about the center shaft.

Referring to FIG. 4, a first end 124 of the film tension band 122 is connected to a film tension spring 126 which is attached to the body 106. A second end 128 of the film tension band 122 is connected to a film tension adjustment 130 which is also attached to the body 106. The film tension adjustment 130 preferably is of the hand screw type known in the art.

To vary the friction force placed upon the central shaft 120 by the film tension band 122, the film tension adjustment 130 is screwed or unscrewed. Increasing the friction force on the film tension roll 118 impedes the feed of the film 28. As the film is dispensed from the film roll 116, the film 28 is unstretched. The unstretched portion of film 28 is indicated by reference numeral 132. The feed of the film 28 is retarded as it passes over film tension roll 118, and the pull of the wrapping operation serves to stretch the film 28. The stretched portion of the film 28 is indicated by reference numeral 134. The process of stretching film is a common practice which increases the performance of the film wrap.

Referring to FIG. 1, the control panel 22 is connected to a source of pressurized air (not shown). Connection may be accomplished by standard quick-connect couplings known in the art. Typically, in manufacturing or industrial plants, a distribution system of plant air will provide a number of supply points to which the control panel 22 may be connected. In the absence of plant air, a portable compressor would suffice.

The control panel 22 governs the flow of pressurized air to the drive cylinder 36, the carriage lift cylinder 20 and the brake assembly 86. The control panel 22 includes a button 136 for upward movement, a button 138 for downward movement and a speed regulator 140 for upward movement and a speed regulator 142 for downward movement. These control operation of the carriage lift cylinder 20. While not visible in FIG. 1, on a left side 144 of the control panel 22, a rotation valve 146 is provided for the drive cylinder 36. A wrap speed regulator 148 also is provided for the drive cylinder 36. The regulators 140, 142, and 148 also have corresponding pressure gauges 150.

Figure 6:
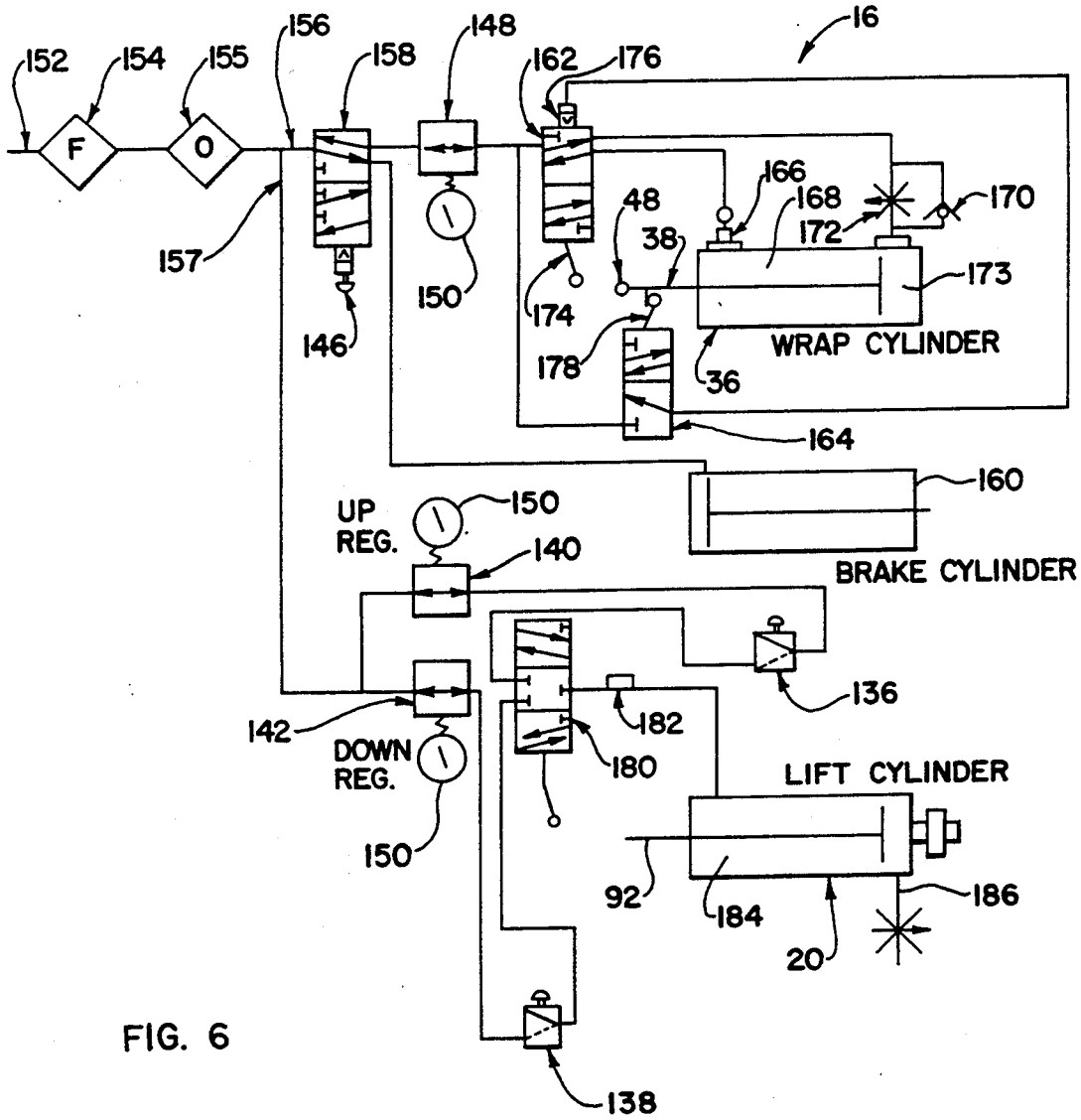
FIG. 6 is schematic diagram of a pneumatic system which controls the operation of the pallet wrapping apparatus embodying the invention.

FIG. 6 illustrates a schematic diagram of the pneumatic power system. The individual pneumatic valves and other components represented in the system are conventional, readily available components.

The pressure source (not shown) connects at connection point 152. Preferably, the operating pressure is within the range of 45 through 60 p.s.i. The pressurized air passes through a filter 154 and an oiler 155. One branch 156 of pressurized air operates the drive assembly 16, and another branch 157 provides air to the carriage lift cylinder 20.

The first branch 156 connects to the rotation valve 146 which controls the drive cylinder 36 and is an air piloted 2-way valve normally closed. The rotation valve 146 connects to an air piloted normally open 3-way valve 158 which supplies line pressure to the brake cylinder 160 when rotation valve 146 is normally closed. To free the rotary arm 14 when rotation valve 146 is depressed, valve 158 closes and vents the line pressure to the brake cylinder 160. Release of rotation valve 146 causes the 3-way valve 158 to restore line pressure to the brake cylinder 160.

To provide line pressure to the drive assembly 16, valve 158 also connects to the wrap speed regulator 148. Speed of the drive cylinder 36 is controlled by regulating the flow and pressure of the air passing through the wrap speed regulator 148.

To operate and control the drive cylinder 36, the wrap speed regulator 148 branches to both a 4-way NC/NO (normally closed/normally open) toggle valve 162 and a 3-way NC (normally closed) momentary valve 164. The toggle valve 162 branches through an in-line dump valve 166 to the retraction side 168 of the drive cylinder 36 and also branches through a check valve 170 and a pressure relief valve 172 to an extension side 173. The toggle valve 162 also has a cam or ball operator 174 and an air piloted snap action operator 176 to toggle the ball operator 174.

The momentary valve 164 has a cam or ball operator 178 which opens the momentary valve 164 when actuated and returns it to a closed position when released. The momentary valve 164 branches to the snap action operator 176 of the toggle valve 162. This snap action operator 176 preferably operates at 40 p.s.i. pressure.

When the wrapping device 10 is not in operation, spring 64 exerts a linear pulling force on the lobe 48 of the cylinder shaft 38. To permit the cylinder shaft 38 to reach full extension, the in line dump valve 166 serves to release the air in the retraction side 168 of the drive cylinder 36. At full extension, the lobe 48 actuates the ball operator 174 to open the branch of the toggle valve 162 leading to the retraction side 168.

In operation, line pressure is supplied through the open branch of the toggle valve 162 to the retraction side 168 of drive cylinder 36. When the cylinder shaft 38 reaches full retraction, the lobe 48 actuates the ball operator 178, thereby opening the momentary valve 164. Momentary valve 164 then supplies line pressure to the snap action operator 176 which toggles the toggle valve 162 so that line pressure is closed to the retraction side 168 of the drive cylinder 36 and line pressure is opened to the extension side 173. As the cylinder shaft 38 extends, the momentary valve returns to its closed position. When the cylinder shaft 38 again reaches full extension, the lobe 48 actuates the ball operator 174 to switch the toggle valve 162 which closes the extension side 173 and again opens the retraction side 168. This reciprocating motion of the cylinder shaft 38 is then converted into rotary motion to drive the rotating arm 14 by the roller bearing clutch 68, as described previously. The cycle continues until the line pressure drops below 40 p.s.i., as dictated by the threshold pressure of the snap action operator 176.

The second branch 157 of pressurized air controls the operation of the carriage lift cylinder 20. The pressurized air branches to both the up speed regulator 140 and the down speed regulator 142. The output of the up speed regulator 140 passes through the up button 136 and then to a valve 180. The up button 136 is an air piloted N/C (normally closed) 2-way valve.

The output of the down speed regulator 142 similarly passes through the down button 138 and then to the valve 180. The down button 138 also is an air piloted N/C 2-way valve. After linking of the outputs of the up button 136 and the down button 138 at valve 180, the common line passes to a rotating union 182. The rotating union 182 allows the flow of air to the retraction side 184 of the carriage lift cylinder 20 during operation of the rotating arm 14.

In operation, the up button 136 is depressed allowing pressurized air to flow through the rotating union 182 and into the retraction side 184 of the carriage lift cylinder 20. A pressure relief valve 186 permits the release of air during retraction of the cylinder shaft 92. The speed of the upward movement of the cylinder shaft 92 may be controlled by regulating the flow and pressure of the air through the up speed regulator 140.

When the down button 138 is depressed, the existing cylinder pressure in the carriage lift cylinder 20 passes through rotating union 182, through the down button 138 and thereafter is vented through the down speed regulator 142, or a pressure relief valve (not shown). The speed of descent of the cylinder shaft 92 may be controlled by regulation of an overflow bypass (not shown) of the down speed regulator 142 or a vent on a pressure relief valve (not shown).

Pneumatic supply lines (not shown) would extend from the control panel 22 to the drive assembly 16, and preferably would be attached to the frame 12. FIG. 2 illustrates the pneumatic lines of the drive assembly 16 which are generally designated by reference numeral 188. A number of possible arrangements exist for placement of the pneumatic lines 188 which would be readily apparent to one skilled in the art. In particular, supplying air from the fixed frame 12 to the rotary arm 14 may be accomplished by using the rotating union 182 and a hollow drive shaft 78 through which a pneumatic line 190 passes.

A further embodiment of the invention would replace the pressurized air of the pneumatic system with a pressurized liquid of a hydraulic system. A fully hydraulic system would essentially incorporate the same structure and principles set forth above.

It is that variations may be occur to the skilled artisan in structural features of the apparatus and still accomplish the salient functions of the apparatus without circumventing the scope of the appended claims to the invention.

I claim:

1. An apparatus detachably connected to a pressurized fluid source for wrapping film around a load on a pallet, comprising:

(a) a support frame;

(b) a rotatable wrapping assembly including a rotatable arm comprising a first end, a second end and mounting means between said first and second ends for rotatably mounting said rotatable arm to said frame, and a carriage rail attached to said second end;

(c) film dispensing means slidably engaged with said carriage rail for dispensing said film to said load;

(d) pressurized lift means mounted to said rotatable wrapping assembly for selectively actuating movement of said dispensing means along said carriage rail when said lift means is connected to said fluid source;

(e) pressurized drive means for selectively actuating rotational movement of said rotating arm when said drive means is connected to said fluid source; and (f) control means connected to said fluid source for selectively controlling said lift means and said drive means.

2. The apparatus according to claim 1 wherein said frame includes a caster assembly attached to a lower end thereof for selective movement of said frame to position said rotatable arm over said load.

3. The apparatus according to claim 1 wherein the first and second ends of said rotatable arm rotate in a plane substantially perpendicular to a vertical axis of said load.

4. The apparatus according to claim 1 wherein said fluid source is a gas source.

5. The apparatus according to claim 4 wherein said lift means of said rotatable arm comprises a first reciprocating cylinder responsive to said gas source supplied by said control means, said first reciprocating cylinder having a cylinder shaft and a connecting means for transferring reciprocating motion of said cylinder shaft to said dispensing means.

6. The apparatus according to claim 4 wherein said drive means of said rotatable arm comprises a second reciprocating cylinder responsive to said gas source supplied by said control means, said second reciprocating cylinder having a cylinder shaft and clutch means in operative engagement with said rotatable arm for transforming reciprocating motion of said cylinder shaft into rotational motion of said rotating arm.

7. The apparatus according to claim 4 wherein said drive means includes a brake means responsive to said control means for selectively impeding the rotational motion of said rotatable arm.

8. An apparatus detachably connected to a pressurized fluid source for wrapping film around a load on a pallet, comprising:

(a) a support frame having a caster assembly attached to a lower end thereof for selective movement of said frame relative to said load;

(b) a rotatable arm comprising a first end, a second end and mounting means between said first and second ends for rotatably mounting said rotatable arm to said frame;

(c) a carriage rail attached to said second end;

(d) film dispensing means engaged with said carriage rail for dispensing said film to said load;

(e) pressurized drive means for selectively actuating rotational movement of said rotatable arm when said drive means is connected to said fluid source; and (f) control means connected to said fluid source for selectively controlling said drive means.

9. The apparatus according to claim 8 wherein said fluid source is a gas source.

10. The apparatus according to claim 9 wherein said drive means of said rotatable arm comprises a reciprocating cylinder responsive to said gas source supplied by said control means, said reciprocating cylinder having a cylinder shaft and clutch means in operative engagement with said rotatable arm for transforming reciprocating motion of said cylinder shaft into rotational motion of said rotating arm.

11. The apparatus according to claim 8 wherein said drive means includes a brake means responsive to said control means for selectively impeding the rotational motion of said rotatable arm.

12. The apparatus according to claim 5 wherein said first cylinder is adapted to be actuated by pressurized fluid to bias said dispensing means upwardly and is adapted to controllably release said pressurized fluid therefrom for permitting movement of said dispensing means downwardly responsive to said release.

13. The apparatus according to claim 1 wherein said drive means is adapted to provide pulsating rotation of said rotatable arm and to permit said rotatable arm to be advanced free of said drive means in the direction of said rotational movement.

14. The apparatus according to claim 8 wherein said drive means is adapted to provide pulsating rotation of said rotatable arm and to permit said rotatable arm to be advanced free of said drive means in the direction of said rotational movement.

* * * * *